United States Patent [19]

Stocker

[11] 4,314,644

[45] Feb. 9, 1982

[54] ZIP SORT REGISTRATION SYSTEM

[75] Inventor: Lester H. Stocker, Phillipsburg, N.J.

[73] Assignee: Bell & Howell Company, Phillipsburg, N.J.

[21] Appl. No.: 149,615

[22] Filed: May 14, 1980

Related U.S. Application Data

[63] Continuation of Ser. No. 913,727, Jun. 7, 1978, abandoned.

[51] Int. Cl.[3] ..... B07C 5/00

[52] U.S. Cl. ..... 209/569; 209/584; 209/617; 209/695; 209/900; 271/225; 271/184; 271/278

[58] Field of Search ..... 209/569, 584, 583, 578, 209/900, 617, 695; 271/225, 184, 64

[56] References Cited

U.S. PATENT DOCUMENTS

| | | | |
|---|---|---|---|
| 3,107,090 | 10/1963 | Templeton et al. | 271/58 |
| 3,520,404 | 7/1970 | Pine | 209/584 |
| 4,014,539 | 3/1977 | Goodwin | 271/184 |
| 4,030,724 | 6/1977 | Goodwin | 271/64 |

*Primary Examiner*—Allen N. Knowles
*Attorney, Agent, or Firm*—Griffin, Branigan & Butler

[57] ABSTRACT

A method and apparatus for segregating articles, such as envelopes (14*a, b,* or *c*) bearing address labels (15) into separate groups, with all the articles in each group having the same unique mark (such as a zip-code-area mark). The apparatus includes a right angle conveyor (12) positioned perpendicular to a discharge conveyor (10), an article deflector plate (20), and two or more freely rotatable balls (38, 40) supported in contact with the right angle conveyor (12) and spaced laterally across the face thereof. At least one freely rotatable ball (38) is selectively removable from contact with the right angle conveyor (12) by a solenoid (18) acting through a beam (32) and a control arm (26). The solenoid (18) is activated by a signal from a detector (16) which detects a change in unique markings on address labels of articles just prior to their engagement with the selectively-removable, freely-rotatable ball and the right angle conveyor.

9 Claims, 3 Drawing Figures

Fig. 1
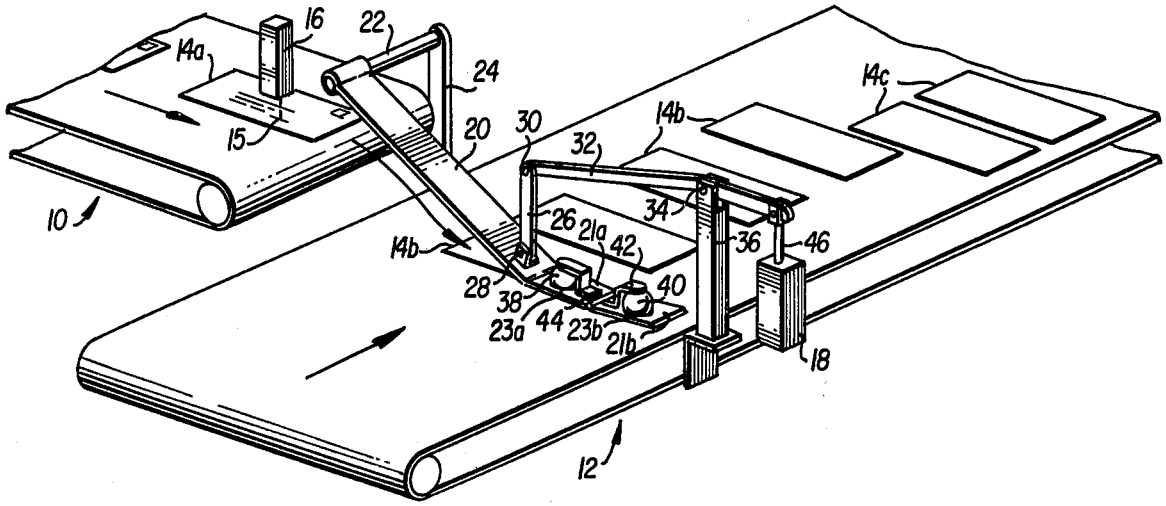
Fig. 2
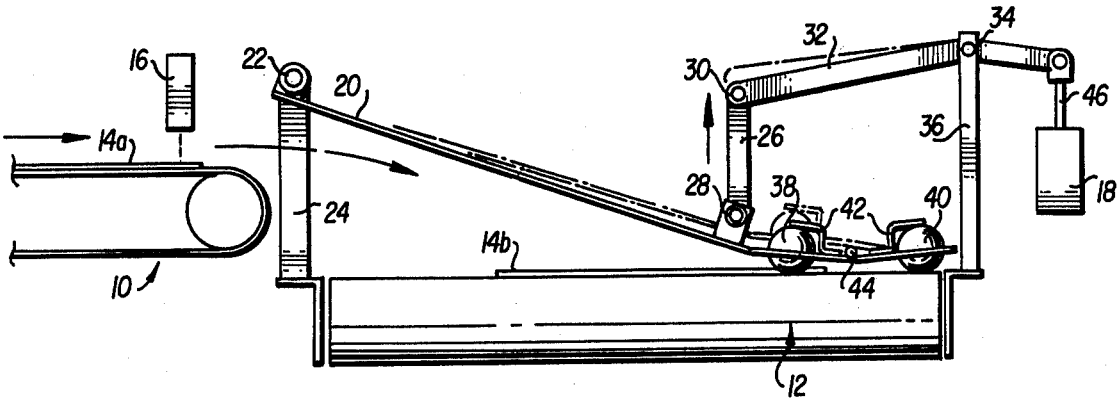
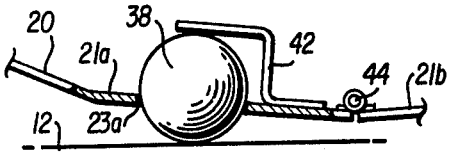
Fig. 3

ZIP SORT REGISTRATION SYSTEM

This is a continuation of application Ser. No. 913,727, filed June 7, 1978, now abandoned.

BACKGROUND OF THE INVENTION

This invention relates to mass mailing equipment and concerns Postal requirements to segregate bulk rate mail into zip code areas for delivery to a Post Office.

It has been the practice of mass mailers to station individuals at final discharge conveyors to manually segregate the mail into zip code areas prior to placing the mail into Postal mail bags.

There have been some efforts made to segregate mail by zip code areas mechanically as disclosed by U.S. Pat. Nos. 3,915,785, 3,557,949, and 3,520,404. The known methods entail marking address labels in such a way that zip code change marks can be detected by detection devices which read the marks on the address labels. In at least one system, at a change in marks a detection device sends a signal to a solenoid which shifts an envelope stopping abutment at a laterally moving conveyor adjacent to an exit end of a discharge conveyor. This causes an offset alignment on the lateral conveyor of the mail articles with different zip-code markings. In addition, these devices require counting, or timing, from the time that a change in marks is detected until the solenoid is activated in order to provide for an intervening article movement between the detection device and the stopping abutment. In this respect, a problem with the prior art is that an undue cost for maintaining the critical accuracy needed for timing, or counting, the delay is required.

Another problem in the prior-art abutment system results from the abruptness with which the articles are thereby stopped. In this respect, the articles are shot onto the laterally moving conveyor where their forward motion is stopped abruptly by the shiftable stopping abutment. This sudden stopping frequently causes the mail articles to bounce back or fall askew on the right angle, or laterally moving, conveyor as they change direction.

It is an object of the present invention to eliminate the need for a time, or count, delay from the point of detection to a shiftable stopping abutment.

It is a further objective of this invention to gradually stop the forward movement of mail articles and transfer their movement in a lateral direction smoothly without bouncing or causing them to fall askew on a right angle, or lateral, conveyor so that they are transported laterally, but in easily distinguishable lines that are completely offset for each group having the same unique marking.

It is a further object of this invention to provide such a device which is relatively uncomplicated and relatively inexpensive to manufacture.

SUMMARY

In accordance with principles of the invention, mail articles are segregated into groups of the same zip code areas by two or more freely rotatable balls which are supported in brackets that can be moved vertically to provide an alternating contact between one of the balls and an upper surface of a right angle conveyor directly in the path of the mail articles as they leave a discharge conveyor in single file from a mass mailing device. The freely rotatable balls are spaced across a face of the right angle conveyor with one ball positioned upstream of the other with respect to the conveying direction of the discharge conveyor. The mail articles are deflected downward from the discharge conveyor to the face of the right angle conveyor and under whichever freely rotatable ball is in contact with the face of the right angle conveyor. Thus, the forward motion of each mail article is smoothly decelerated and stopped and, at that position, a lateral movement is imparted to the mail article by the right angle conveyor.

The vertical movements of the freely rotatable ball are controlled by a solenoid which is activated by a signal from a detection device positioned over a path of the mail articles near the end of the discharge conveyor. As a unique mark on a mail article's label is detected by the detecting device, it transmits a signal to the solenoid to lift an upstream, or front, freely rotatable ball, thus allowing the mail articles to thereafter pass under the upstream ball and be decelerated and stopped by the downstream freely rotatable ball and moved laterally from that position by the right angle conveyor. As a different mark on a mail article's label is detected by the detection device, it then sends another signal to the solenoid which lowers the upstream ball into contact with the right angle conveyor where all the mail articles with the different mark are then decelerated, stopped and moved laterally from a new position which is upstream of, or forward of, the position of the previous mail articles.

BRIEF DESCRIPTION OF THE DRAWINGS

The foregoing and other objects, features and advantages of the invention will be apparent from the following more specific description of the preferred embodiments as illustrated in the accompanying drawings in which like referenced characters refer to the same parts throughout the various views. The drawings are not necessarily to scale, emphasis instead being placed upon illustrating principles of the invention.

FIG. 1 is an isometric view of a zip code stagger sorter apparatus in accordance with the present invention;

FIG. 2 is a fragmented simplified cross-sectional side view of the FIG. 1 apparatus; and FIG. 3 is a fragmented simplified cross-sectional view of the freely rotatable ball device.

DESCRIPTION OF THE PREFERRED EMBODIMENT

The drawings portray an endless discharge conveyor 10 delivering a mail article envelope 14*a, b,* or *c* with an address label 15 onto a right angle endless conveyor 12 which is perpendicular to the discharge conveyor 10. The conveyors convey in the directions indicated by arrows appearing thereon in FIG. 1. A deflector plate 20 is mounted at its upper end to a pivot rod 22 which is supported from a vertical frame member 24. Lower end portions 21*a* and *b* of the deflector plate 20 define apertures 23*a* and *b* for containing two freely rotatable balls 38 and 40. The balls 38 and 40 are held in position in their apertures 23*a* and 23*b* by brackets 42 fastened to the end portions 21*a* and *b*. It should be noted that the balls 38 and 40 normally engage the endless conveyor 12 to rotate therewith. However, the apertures 23*a* and *b* are appropriately arranged and shaped such that when the end portions 21*a* and *b* are lifted away from the endless conveyor 12, the balls 38 and 40 are lifted from engagement with the conveyor 12. Midway between balls 38 and 40, there is a pivot hinge 44 formed on the deflector plate 20 which allows balls 38 and 40 to alternately contact the lateral conveyor 12. An intermediate portion of the deflector plate 20 is attached to an upward-downward movable control arm 26 by a lower pivot joint 28. The control arm 26 is attached at an upper end by an upper pivot pin 30 to a first end of the beam 32. The beam 32 is supported by a beam support bracket 36 at a beam pivot pin 34. The other end of the beam 32 is pivotally attached to a solenoid actuator rod 46 of a solenoid 18.

In operation, when a detector 16 detects a different unique marking on an address label 15 (which is attached to a mail article 14*a, b,* or *c*) it transmits a signal to the solenoid 18 which then, through beam 32 and control arm 26, activates the solenoid to lift the deflector plate 20 and the freely rotatable ball 38 only up from contact with conveyor 12. In this respect, the pivot hinge 44 pivots to allow the rotatable ball 40 to remain in contact with the conveyor 12. The detected mail article 14*c* is deflected downwardly from the discharge conveyor 10 by the deflector plate 20 to the surface of the right angle conveyor 12 and passes under freely rotatable balls 38 and 40 where the mail article's 14*c* forward motion is smoothly decelerated and stopped, and a lateral movement is imparted to it at a desired line, or position, by pressure between the downstream freely rotatable ball 40 and the right angle conveyor 12. This position, or line, on right angle conveyor 12 will be continued for all subsequent mail articles until such time as the detector 16 detects a change in a unique mark on a label 15. Detector 16 then sends another signal to the solenoid 18 which responds through the beam 32 and the control arm 26 by lowering the deflector plate 20 so that the freely rotatable ball 38 is brought into contact with the surface of right angle conveyor 12. At this time, the mail articles 14*b* with the changed unique marks on their address labels 15 are deflected downwardly by the deflection plate 20 and are decelerated and stopped by the upstream or first freely rotatable ball 38 and a lateral movement is imparted to them by the right angle conveyor 12 at a different position or line.

In one embodiment, the address labels 15, from different zip code areas, are uniquely marked by spraying an ultraviolet dye on all the labels from a zip code area, and not spraying dye on labels from the next zip code area. The spraying of the labels is performed on the labels of every other zip code area prior to cutting them apart on the labelling machine. In this case, the detector 16 is an ultraviolet detection device of known art such as that taught by Warren et al. in U.S. Pat. No. 3,650,400.

The unique markings on the address labels 15 may be any type of characterizing marks on the respective labels which can be distinguished by detecting devices available within known art today.

As can be seen, this very simple device detects a change in unique marks on labels of mail articles just before they leave the discharge conveyor 10 and immediately initiates movement of the ball 38. Movement of the ball 38 is quite simple and can easily be completed before envelopes carrying mark changes contact the deflector 20. Thus, no time delay, or complex counting mechanisms are required. That is, as is shown in FIG. 1, when an address label on a mail article 14*a* is first scanned by the detector 16, the immediately preceding mail article 14*b* has already been registered, and there are no intervening mail articles between the articles 14*a* and *b*.

In addition, it can be readily seen that mail articles are decelerated smoothly and stopped, relative to the direction of travel of the discharge conveyor 10, without a violent jolt by a freely rotatable ball 38 or 40 cooperating with the right angle conveyor 12 rather than being jolted or knocked askew by an abutment wall, for example. At the same time the freely rotatable ball which engages the mail articles allows the mail articles to move laterally with the right angle conveyor. 12.

While the invention has been particularly shown and described with reference to a preferred embodiment thereof, it will be understood by those skilled in the art that various changes in form and details may be made therein without departing from the spirit and scope of the invention.

The embodiments of the invention in which an exclusive property or privilege is claimed are defined as follows:

1. Apparatus for segregating into separate groups flat articles such as envelopes or documents bearing address blocks having at least one unique destination indicium associated therewith, all articles in each group having address blocks with the same unique destination indicium associated therewith, said apparatus comprising:

a discharge conveyor for conveying and discharging said flat articles along a first path;

indicating means for indicating the existence of said unique destination indicium for each of said flat articles before said flat article is discharged from said discharge conveyor;

a selection means;

tranmsitting means coupled to said indicating means for transmitting an action signal to said selection means in response to a change in said unique destination indicium;

laterally moving conveyor means;

said selection means including a movable portion articuately joined to a relatively stationary portion said movable portion being operative in response to said action signal to selectively move between a first position in engagement with said laterally moving conveyor means and a second position out of engagement with said laterally moving conveying means;

said movable portion being further operative, when in said first position, to engage said flat articles and change their direction to move said articles along a first lateral path on said lateral conveyor; and, said relatively stationary portion being operative, when said movable portion is in said second position, to engage said flat articles and change their direction to move along a second lateral path on said lateral conveyor means.

2. Apparatus as in claim 1 wherein said selection means further comprises:

a first rotatable ball movable into and out of contact with said upper surface of said laterally moving conveyor means; and, a second rotatable ball articulately joined to said first rotatable ball and having a position for substantially maintaining contact with said upper surface of said laterally moving conveyor means.

3. Apparatus as in claim 2 wherein said selection means further comprises:

a deflector plate pivoted at an upper portion thereof and attached to a control arm at an intermediate portion thereof, said deflector including a ball-supporting means at its lower portion for supporting and positioning said first and second rotatable balls, said control arm being vertically movable in response to said action signal for lifting at least said first ball from said laterally moving conveyor means.

4. Apparatus as in claim 3 wherein said deflector plate is positioned downstream of said discharge conveyor for engaging flat articles discharged from said discharge conveyor, said deflector being inclined downwardly to deflect said discharged flat articles downwardly toward said laterally moving conveyor means, the forward inertia of said flat articles carrying said flat articles to become gripped between at least one of said balls and said laterally moving conveyor means.

5. Apparatus of claim 1 wherein said laterally moving conveyor means is an endless conveyor.

6. A method of segregating into separate groups flat articles such as envelopes or documents bearing address blocks having at least one unique destination inducium associated therewith, all articles in each group having the same unique destination indicium associated therewith, said method comprising the steps of:

conveying said flat articles along a first path by means of a first conveyor;

indicating the existence of said unique destination indicium for each of said flat articles before each such flat article is discharged from said first conveyor;

transmitting an action signal to a selection means in response to a change in said unique destination indicium;

discharging said articles onto a laterally moving second conveyor;

engaging said flat articles as said flat articles are discharged from said first conveyor along said first path and decelerating and stopping the movement of said flat articles along said first path at a selected one of at least two positions, said deceleration and stopping further comprising the steps of:

selectively moving a first rotatable ball articulately joined to a second rotatable ball into or out of contact with the upper surface of said second conveyor in accordance with said action signal from the transmitting means to permit said first rotatable ball to engage selected flat articles between said first ball and said upper surface to decelerate and stop the selected flat articles; and, permitting said flat articles to be engaged between said second rotatable ball and said upper surface when said first rotatable ball is selected to be out of contact with said upper surface; and, laterally moving said flat articles along one or the other of at least two paths lateral to said first path depending upon whether said flat articles are engaged by said first rotatable ball or said second rotatable ball.

7. The method of claim 6 including the steps of deflecting said flat articles downwardly toward said second conveyor as said articles are discharged from said first conveyor; and permitting the inertia of said articles to cause said articles to engage between the upper surface of said second conveyor and one of said articulately joined rotatable balls.

8. The method of claim 7 including the simultaneous vertical movement of said deflecting means and one of said rotatable balls upon receipt of said actional signal by said selection means.

9. The method of claim 6 or 7 or 8 wherein the lateral motion of said articles along one of said two paths is by means of an endless conveyor.

* * * * *